US007946100B2

(12) United States Patent
Justen et al.

(10) Patent No.: US 7,946,100 B2
(45) Date of Patent: May 24, 2011

(54) SHRINKING PROCESS FOR PRODUCING SOLID, TRANSPORTABLE AND PRINTABLE CONTAINERS AND A DEVICE FOR CARRYING OUT A SHRINKING PROCESS OF THIS TYPE

(75) Inventors: Heinrich Justen, Mechernich (DE); Markus Dumon, Euskirchen (DE); Andre Miszewski, Buellingen (BE); Kurt Jansen, Schleiden (DE)

(73) Assignee: KHS GmbH, Dortmund (DE)

( * ) Notice: Subject to any disclaimer, the term of this patent is extended or adjusted under 35 U.S.C. 154(b) by 118 days.

(21) Appl. No.: 12/096,724

(22) PCT Filed: May 19, 2006

(86) PCT No.: PCT/DE2006/000870

§ 371 (c)(1),
(2), (4) Date: Sep. 16, 2008

(87) PCT Pub. No.: WO2007/065385

PCT Pub. Date: Jun. 14, 2007

(65) Prior Publication Data

US 2009/0013649 A1 Jan. 15, 2009

(30) Foreign Application Priority Data

Dec. 9, 2005 (DE) ..... 10 2005 059 295

(51) Int. Cl.
*B65B 53/02* (2006.01)

(52) U.S. Cl. ..... 53/442; 53/453; 53/48.2; 53/557

(58) Field of Classification Search ..... 53/442, 53/443, 453, 48.2, 48.3, 48.6, 557, 545
See application file for complete search history.

(56) References Cited

U.S. PATENT DOCUMENTS

| | | | | | |
|---|---|---|---|---|---|
| 3,222,800 | A * | 12/1965 | Siegel et al. | ..... | 34/212 |
| 3,309,835 | A | 3/1967 | Peppler | | |
| 3,353,333 | A | 11/1967 | Arvidson | | |
| 3,430,358 | A | 3/1969 | Denker | | |
| 3,744,146 | A * | 7/1973 | Nichols | ..... | 34/212 |
| 3,866,331 | A * | 2/1975 | Evans, Jr. | ..... | 34/216 |
| 3,869,844 | A * | 3/1975 | Edouard | ..... | 53/442 |
| 3,889,394 | A * | 6/1975 | Fischer | ..... | 34/225 |
| 4,676,006 | A * | 6/1987 | Tolson | ..... | 34/443 |
| 4,830,895 | A * | 5/1989 | Bernard | ..... | 428/34.2 |
| 5,062,217 | A | 11/1991 | Tolson | | |
| 6,648,634 | B2 * | 11/2003 | Nava | ..... | 432/121 |
| 6,689,180 | B1 * | 2/2004 | Liao | ..... | 53/557 |
| 6,772,575 | B2 * | 8/2004 | Limousin | ..... | 53/442 |
| 7,328,550 | B2 * | 2/2008 | Floding et al. | ..... | 53/442 |

* cited by examiner

*Primary Examiner* — Sameh H. Tawfik
(74) *Attorney, Agent, or Firm* — Leason Ellis LLP

(57) ABSTRACT

The invention relates to a shrinking process for producing solid, transportable and printable containers by wrapping the articles to be packaged with a film in such a manner as to produce an overlapping section of the film ends on the base area, heating by heat exchange or convection in order to seal the free ends in the area of overlap, and finally heating in a shrinking oven, the container so produced being stabilized by the shrinking process. The method comprises first locally limiting the incoming hot air to the base area of the container to form a peripheral shell in the area of the bottle bottoms, the shape of the container being stabilized thereby, while the container is continuously transported during stabilization and the hot air directed onto the base area of the container in a bundle of discretely distributed gas jets is thereby discharged and guided back after a locally limited heat transfer with the film, and more hot gas is directed laterally against the continuously transported container at an increased lateral blow speed in order to complete the shrinking process. The invention further relates to a device for carrying out the shrinking process.

7 Claims, 8 Drawing Sheets

SHRINKING PROCESS FOR PRODUCING SOLID, TRANSPORTABLE AND PRINTABLE CONTAINERS AND A DEVICE FOR CARRYING OUT A SHRINKING PROCESS OF THIS TYPE

CROSS-REFERENCE TO PRIOR APPLICATION

This is a U.S. National Phase application under 35 U.S.C. §371 of International Application PCT/DE06/000870, filed May 19, 2006, and claims benefit of German Patent Application No. 10 2005 059 295.3, filed Dec. 9, 2005, both of which are incorporated herein. The International Application was published in German on Jun. 14, 2007 as WO 2007/065385.

BACKGROUND OF THE INVENTION

The invention relates to a shrinking process for producing solid, transportable and printable containers, in particular bottle containers with a height/width ratio of >1.

FIELD OF THE INVENTION

Shrinking processes for producing solid, transportable and printable containers are carried out nowadays in many forms with film packages that are used as a sales unit of bottles. The film is hereby also used as an advertising medium, e.g., for beverage bottles that are wrapped with a shrink film. Usually hot gases are used to heat the shrink films, in which gases the thermal energy is transferred by convection to the surface of the article to be heated.

WO 02/36436 A1 describes a multiple-zone shrink tunnel with a pre-shrink zone with ambient hot air and a heat zone in which a lateral final hot-air impingement of the articles wrapped in film takes place. The articles are hereby first preferably assembled into groups and wrapped in film, preferably using a solid transport tray. The film ends overlapping on the container base are sealed by a broad application of hot air and, after a pre-shrinking process, subjected to the subsequent shrinking process. To ensure the finished containers are printable, they must have constant dimensions and flat surfaces. Moreover, the printable surface must provide sufficient resistance to the print roll bearing against it during printing, since otherwise a blurred printed image is produced. These requirements lead to containers with the same spatial dimension and reproducible relative positions of the transport articles.

It was established that particularly in transport during the packaging of articles with a high center of gravity, such as, e.g., in the case of bottles with a height/width ratio of over >1, preferably >2, the articles standing upright in the area of overlap of the film ends tend to change their position relative to the other articles by tipping. The vibrations and shocks of the container that are inevitable in the production process and during transport cause an instability and unevenness of the shrinking during the shrinking process. Attempts were therefore made using a solid tray to produce a container with the same spatial dimension and reproducible relative positions of the objects to one another. However, since these are mass produced articles with relatively low individual prices, the separate feed of a tray for the production of particularly stable containers is out of the question due to the increased economic application of material and energy.

With certain products, a heating of the entire product is permissible only to a limited extent, e.g., in the case of foodstuffs such as cooled dairy products or pressurized beverages to which carbon dioxide has been added. The shrink temperatures were therefore reduced, which prolonged the process duration. However, the lower temperatures led to problems during heat-sealing, so that the necessary strength in the container encasement was not always achieved.

The inventors also ascertained that although a sealing of the overlapping film ends at lower temperature avoided any appreciable heating of the articles themselves, in particular with a continuous transport of the containers it is associated with the problem that the wrapping film is inflated and slips during the lateral application of hot air, This intensifies the already described tendency of individual objects of the articles to be packaged to tip or change position.

The object of the present invention was therefore to offer a shrinking process and a device for carrying out this shrinking process that makes it possible without a separate tray to produce a solid container of articles with a height/width ratio of >1, preferably >2, with uniform package density and geometric shape, the individual articles being heated at most superficially. In the case of units that should or must be heated only at the surface this means that the core temperature must be kept low and the energy output to the environment must be reduced. Further aspects are space requirements, process control with flexible container sizes and reduction of environmental pollution through emission of film materials.

BRIEF SUMMARY OF THE INVENTION

This object is achieved with a shrinking process, comprising covering the articles to be packaged with a film such that an overlapping section of the film ends is formed on the base surface, heating by heat transfer or convection in order to seal the free ends in the area of overlap and a final heating, the container so produced being stabilized at the same time by the shrinking process.

With the new shrinking process it was possible to achieve an efficient energy transfer, wherein the heat-transfer coefficient between the media or substances involved, the type and size of the respectively heated surface and the flow velocity of the hot gas over the entire heat exchange or convection surface and the gas exchange with the environment was optimized. It was possible through certain measures to keep the core temperature low and to locally heat seal the packaging film by a narrow limitation of the high temperatures, wherein the individual objects (packaged goods) were heated to the necessary shrink temperature for a short time only at their surface. Furthermore, it was possible to reduce the energy output to the environment in that the hot air used to seal the film ends overlapping in the base area was directed only at the base area of the container in a locally limited manner. It was therefore possible to achieve a rapid shape stabilization of the container through the formation "in situ" of a peripheral shell, so that the articles were already fixed in their position relative to one another at the start of the shrinking process. The container already stabilized in the base area thus withstood even higher pressure stresses during lateral application of hot air, so that it was possible to restrict the blowing process to a short treatment duration.

At the same time the advantage resulted with continuous transport, in particular with containers with a large floor area, that it was possible to avoid a heat accumulation in the center floor area or an inadmissible heating of the articles to be packaged through the loaded hot air. There had hitherto been a danger of the side sections of the container being heated through the hot air streaming from all sides and influencing the shrinking process of the wrapping film unevenly. It was possible to solve this problem through a rapid continuous transport of the container on a reticular structure in combination with a local impingement of the base areas with hot air. Hot air is hereby introduced in bundles of discretely distributed gas jets into a convection zone, which is limited by the container base on the one hand and outlet air openings on the other hand. The hot air flowing in is deflected with deep interaction with the film on the container base and guided back to the gas circulation system with the reverse flow direction. This form of hot gas guidance is described below as a reverse flow. It is achieved through a parallel movement of convection zone and container base at different speeds that during the transport of the container the convection zone slowly moves with it over the entire base surface without causing a heat accumulation or irregular shrinking of the film at the container sides. Through the particular gas guidance in the form of a reverse flow, the heat transfer is carried out in a defined convection zone from the hot gas into the base area of the container. The local energy input can thereby be optimally adjusted to the material thickness or density of the film by control of the flow velocity of the hot gas and optimally adjusted over the exactly definable heat exchange or convection surface.

The advantages described above are attained according to the invention in a surprisingly simple and economic manner. The invention is described in more detail below based on several exemplary embodiments.

DETAILED DESCRIPTION OF THE INVENTION

Figure 1:
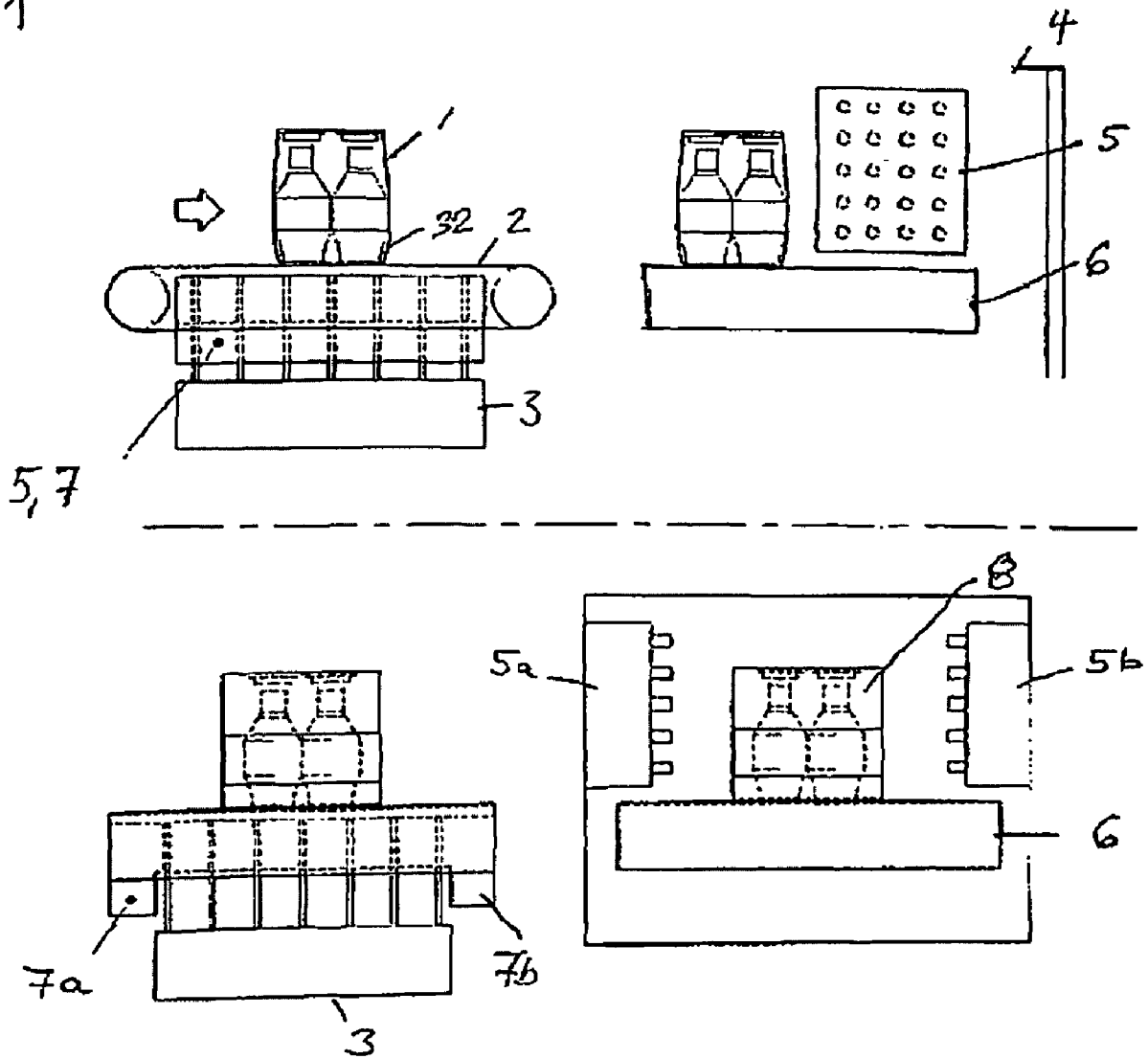
FIG. 1 Basic structure of a shrink wrapping machine for producing solid transportable and printable containers (front view and side view).

The upper portion of FIG. 1 shows the device according to the invention for carrying out a shrinking process in front view. The inlet air and outlet air system 5, 7 is discernible with the container 1, which is arranged on a conveyor belt 2 over a hot air source 3. The hot air applied in reverse flow (see arrow directions in FIG. 3) serves to form a pre-stabilizing peripheral shell 32 in the base area of the container.

In the right portion of FIG. 1 the container 1 is shown in a machine that has a lateral hot air supply. The articles (bottles) of the container are conveyed via a transport belt 6 in the product travel direction through the shrink wrapping machine 4. As soon as the container 1 with the wrapping film 8 arrives in front of the hot air supply 5 there is a danger that the film wrapping will be inflated by the air pressure and will be in danger of slipping thereby. This is prevented by the peripheral shell formed in advance in the area of the container base, which peripheral shell stabilizes the shape of the container and thus the arrangement of the articles.

The lower portion of FIG. 1 shows the shrink wrapping machine in side view, wherein at the side next to the hot air source 3 an outlet air system 7A 7B is indicated in the left part of the machine. The outlet air is guided completely or in part into the circulatory flow to process the hot air or recycled, so that a heat accumulation can be avoided in interaction with the continuous transport.

Figure 2:
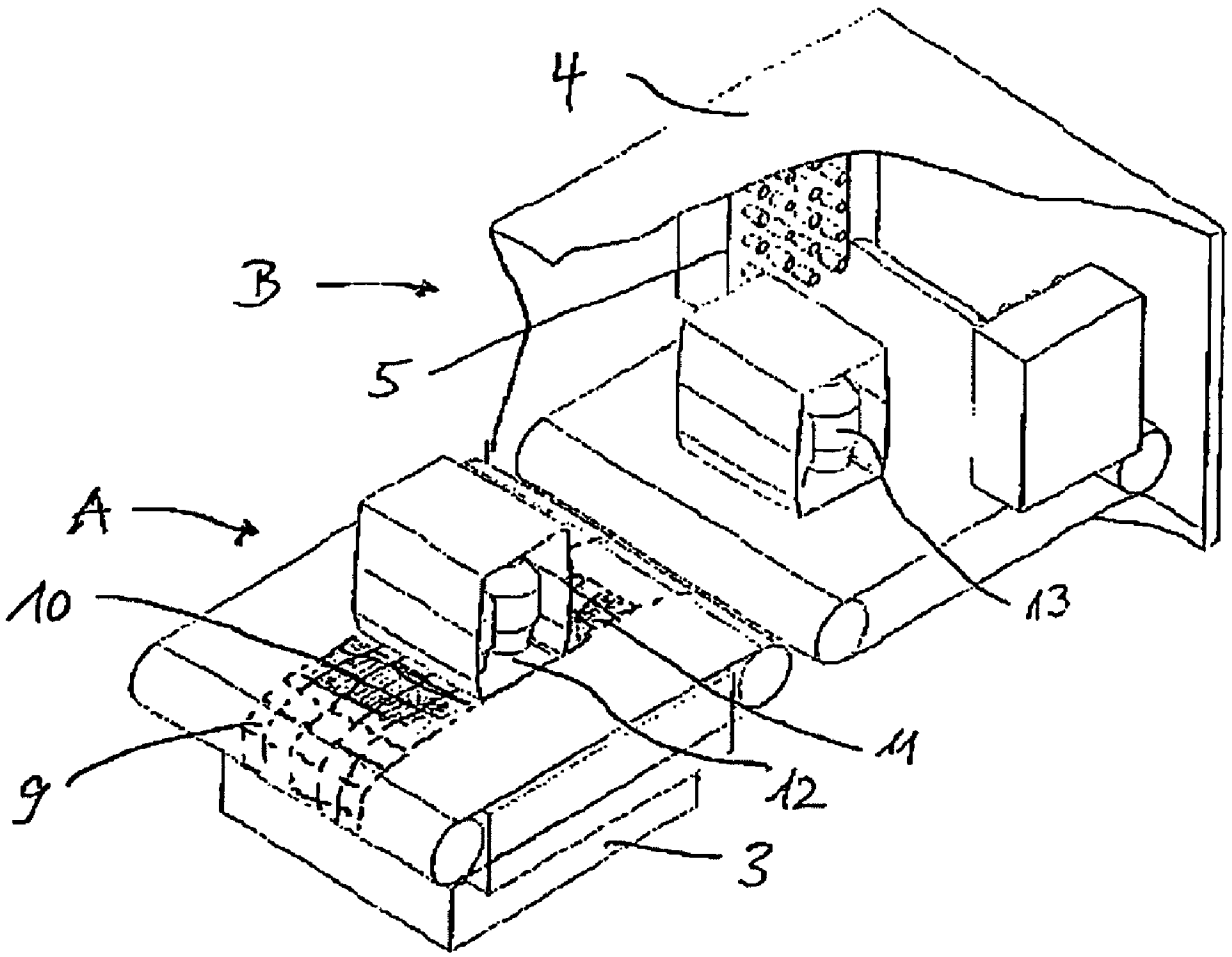
FIG. 2: Perspective view of a shrink wrapping machine embodied according to the invention FIG. 3 Basic representation for reverse flow and embodiment of a peripheral shell based on a cross section through an air change plate FIG. 4 Transport of a container via a device embodied according to the invention for hot gas impingement in the base area of the container FIG. 5 Perspective view of the device for hot gas impingement FIG. 6 Overall view of the device for embodying a peripheral shell FIG. 7 Structure of a device embodied according to the invention for forming a peripheral shell FIG. 8 Flow chart of the method according to the invention for producing solid transportable and printable containers

The right portion of the shrink wrapping machine shows the horizontally acting hot air nozzles 5*a* 5*b*. They introduce the shrinking process from all sides on the container enclosed by a wrapping film 8. In the perspective representation according to FIG. 2 the two sections (embodiment of the peripheral shell, finished shrinkage) are shown analogously to FIG. 1. The hot air input is embodied as a reverse flow under the conveyor belt 2. In the convection area the reticular structure of the conveyor belt 2 is partially covered by the sliders 10, 11. This ensures that only the base area 12 of the transported container or a partial area is acted on by the hot air flowing in (moving convection zone).

In section 4 of the machine the hot gases flow at high pressure out of the laterally arranged nozzles 5. The flow velocity can be further increased and directed constantly over the entire area against the film 8, since the container has already been stabilized on the base area such that the film 8 wrapped around the bottle-shaped articles 13 withstands a high lateral pressure load.

With a subsequent cooling by blowing with cold air (not shown), on the one hand the plastic is converted from the plastic range to the elastic range, wherein the maximum stresses in the material rise and it thereby solidifies. On the other hand, the film also shrinks during this cooling, through which the stresses in the film increase and the holding forces stabilizing the container reach the necessary size. If the environment is too hot, active cooling must be carried out, since the temperature of the ambient air is not sufficient for solidification.

Figure 3:
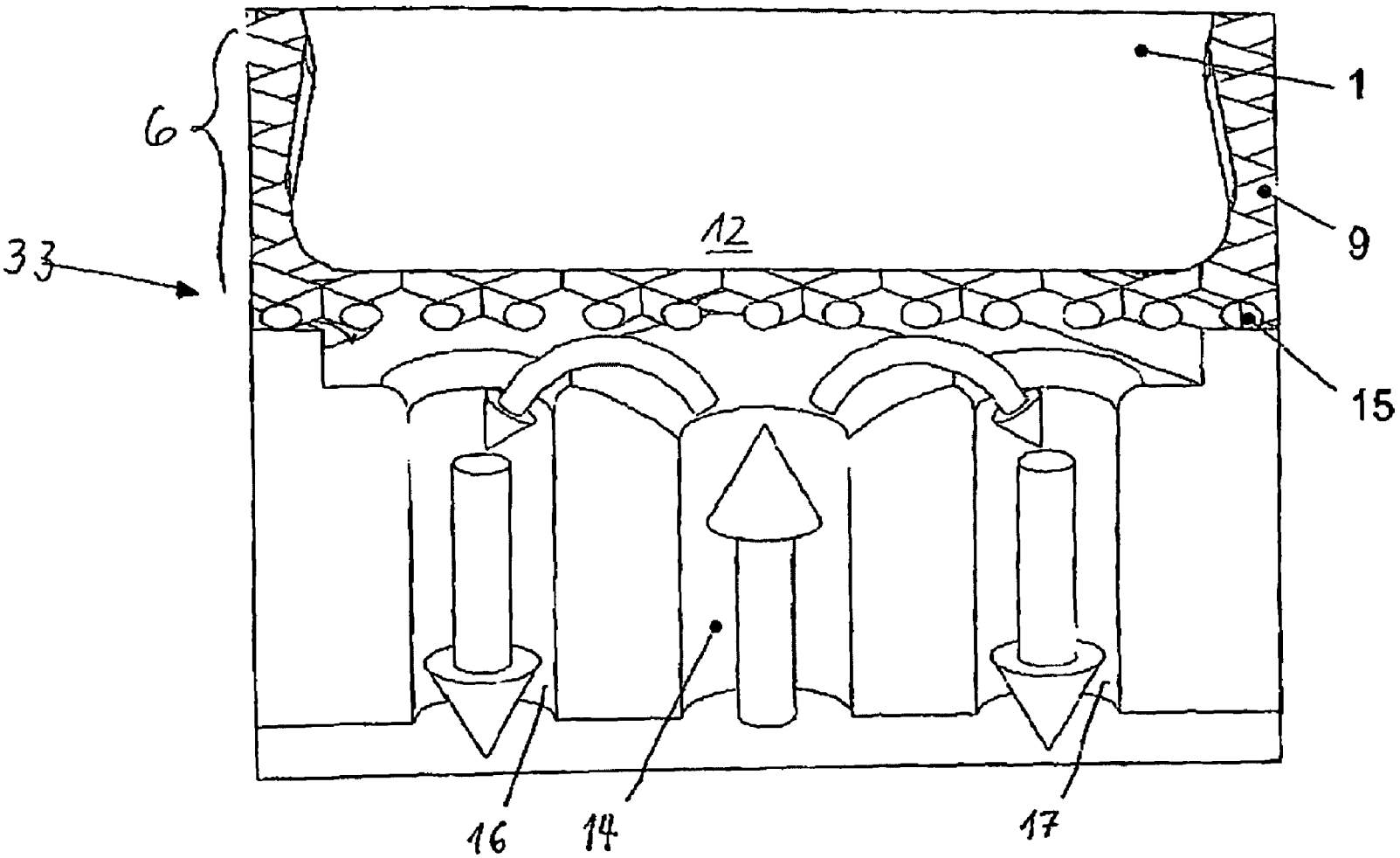

The principle of reverse flow is explained below in connection with the partial cross section through an air change plate shown in FIG. 3:

The container 1 stands on a reticular or latticed structure 9 so that the hot air flowing out of the nozzle bank 33 via nozzle 14 has access to a convection zone 15 of the transport belt 6. In the convection zone 15 the heat transfer takes place from the hot gas through convection into the base area 12 of the container. After deflection to the surface of the container base, the hot gas flows in the arrow direction via suction openings 16, 17 into the outlet air region.

Figure 4:
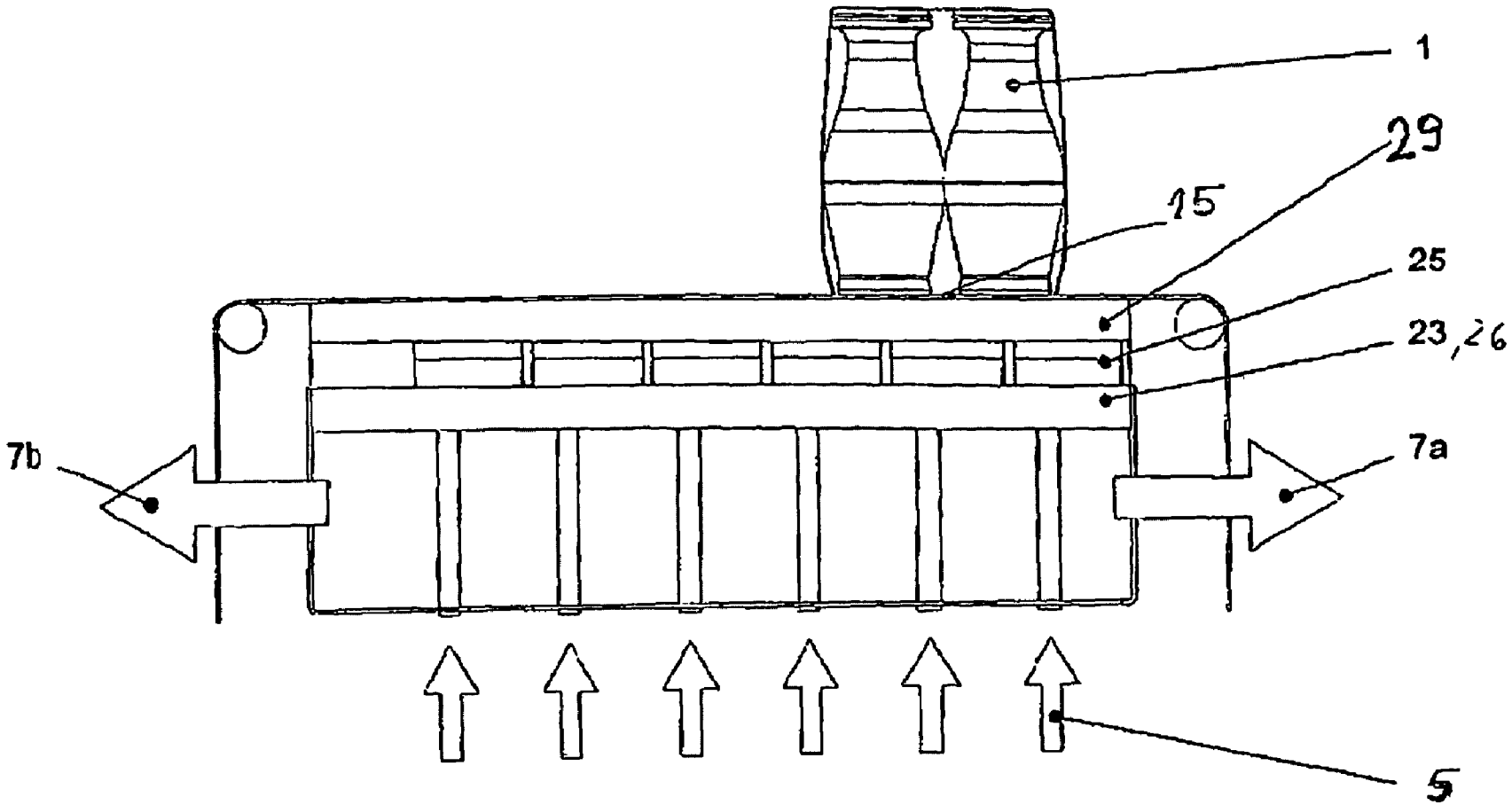

FIG. 4 shows the transport of the container 1 via an air change plate 29 embodied according to the principle of reverse flow according to the invention with convection zone 15 to form a stabilizing peripheral shell. The flow direction of the hot inlet air 5 is thereby deflected into the outlet air system 7*a*, 7*b*. The local control of the longitudinal and transverse sliders 23, 26 is not shown. This is necessary in order to be able to achieve the movement together of convection zone and base area 12 of the container while avoiding a heat accumulation.

Figure 5:
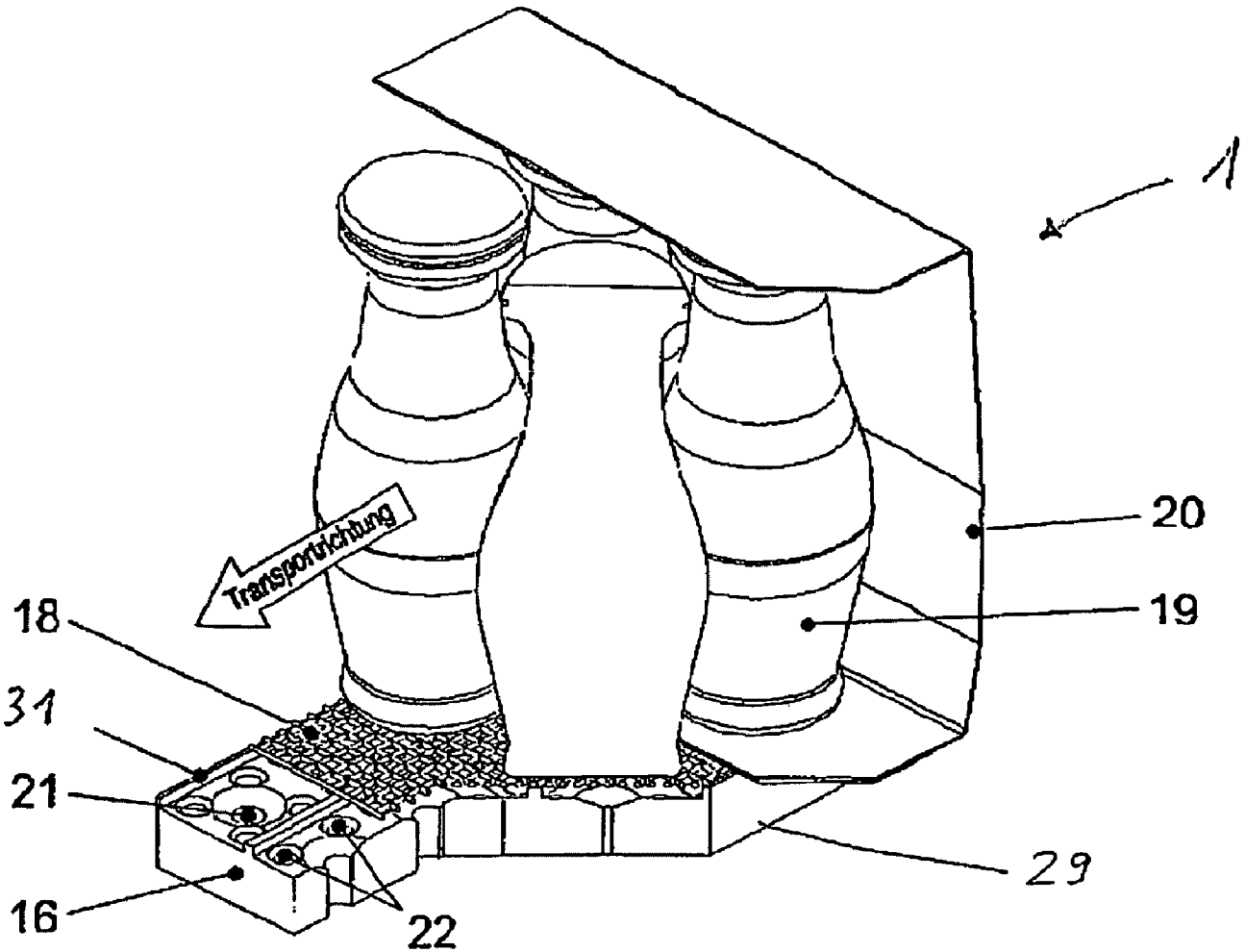

The left edge of the image shows in the partial cross section of FIG. 5 a preferred variant of the air change place 29 embodied according to the invention for the discrete hot air impingement in the region of the container base. The air change plate 29 contains sliding webs 31 on which the reticular transport belt 18 is supported. The container 1 contains a plurality of products 19 wrapped with a shrink film 20.

Figure 6:
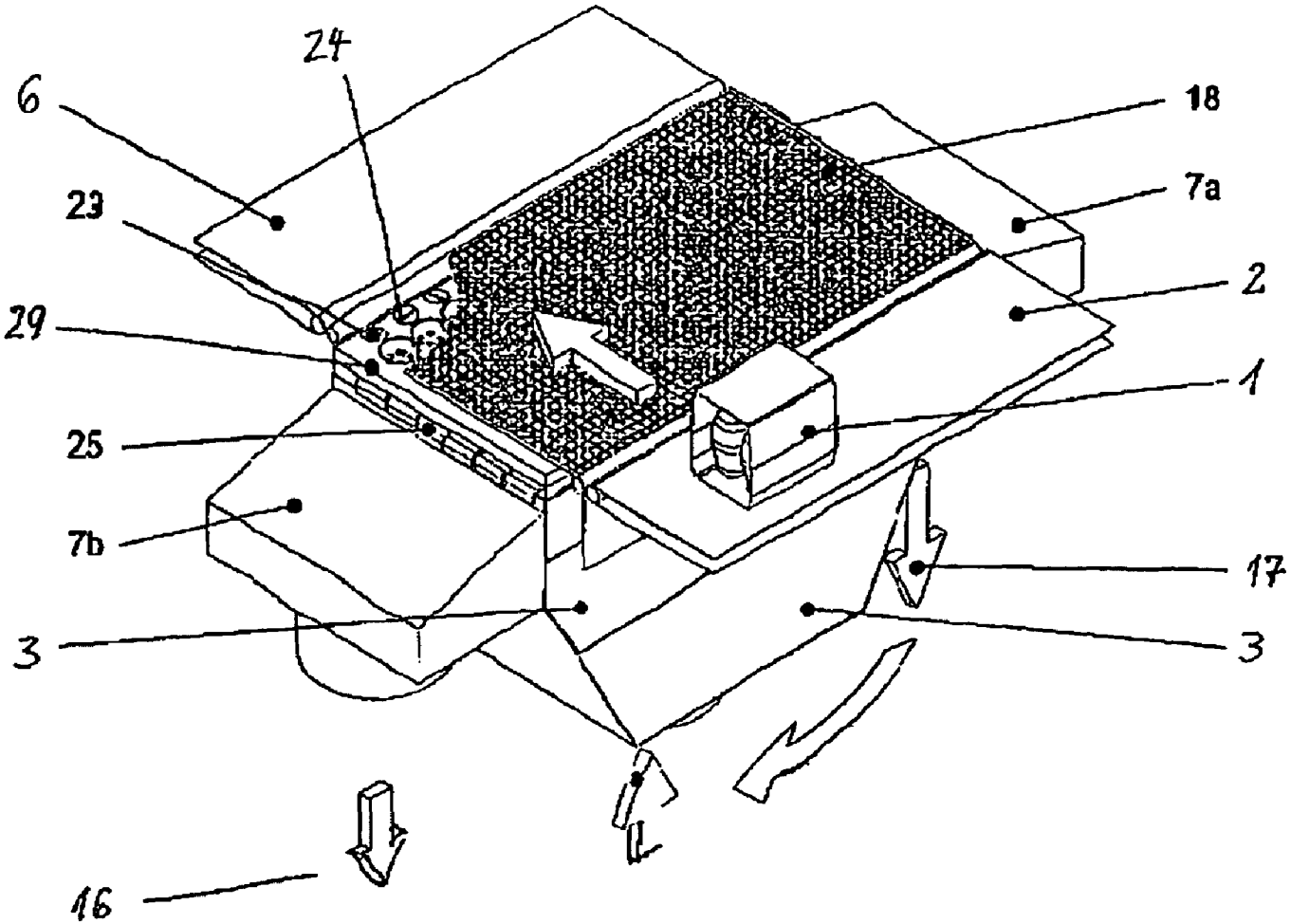
Figure 7:
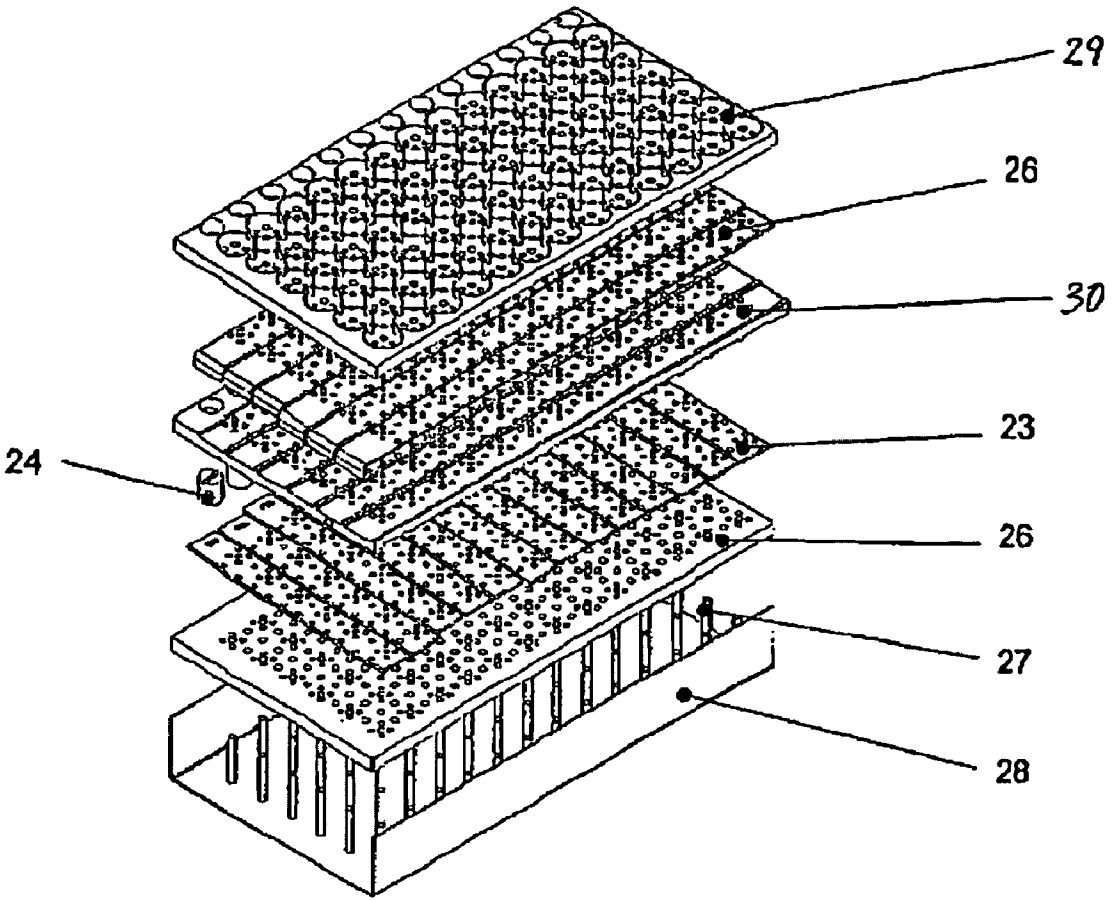

If the transport of the container 1 takes place in the arrow direction via the air change plate 29, the inlet air units 21 and the outlet air units 22 are controlled via transverse and longitudinal sliders arranged in a register-like manner. This control, also called "zone activation," is shown in FIG. 6 and FIG. 7 and is described in detail below:

The zone activation can be carried out in a manually or automatically controlled manner. In the example according to FIG. 6, the container 1 is conveyed in the arrow direction via the reticular transport belt 18 into the area of influence of the hot air source 3 (perpendicular arrow). In the examples shown here the longitudinal slider 23 is adjusted manually. This can be carried out via an eccentric adjustment 24 pursuant to FIG. 7. In the transverse direction the slider adjustment is carried out in a manner controlled via a zone activation 25, with the aid of which the transverse sliders 26 either activate or switch off the inlet air depending on the position of the product or the container 1 on the transport belt 18. According to the exemplary embodiment, a perforated plate as a transverse slider 26 as well as tubes 27 for the hot air supply and a separator housing 28 for the inlet and outlet air are necessary to control the zone activation.

The above example shows how the hot gas to form a stabilizing peripheral shell is guided according to the principle of reverse flow in the device according to the invention. The heating area is represented by an air change plate that comprises a special gas guidance in which the gas is transferred from an open to a closed circulation system. A field of recesses, e.g., in channel or bell form, is arranged on the heating area, wherein a centrally arranged inlet air unit in the form of a nozzle is arranged in each bell, which nozzle has a very small spacing from the heating surface, One or more outlet air units in the form of suction openings are located at the side of the bell, the diameter and number of which openings is selected such that the inlet air flowing in is suctioned off after deflection to the container base area.

The reverse flow can be described in connection with the partial cross section through a guide plate according to FIGS. 3 and 5 based on a schematic diagram. The container 1 stands on a reticular or latticed structure 9 or 10 so that the hot air flowing out of a depression or bell has an access to the convection zone 15. In the convection zone 15 the heat transfer takes place from the hot gas through convection into the base area of the container. After deflection to the surface of the container base, the hot gas flows via suction openings 16, 17 back into the outlet air region.

With this arrangement, it is ensured that the recesses, or in the present case the bells, are always totally or at least on the edge covered completely by the base of the container. The influence of infiltrated air is minimized through the reverse flow. The embodiment of a stabilizing peripheral shell is achieved even with the use of less energy and a lower inlet air quantity. This applies even with a parallel relative movement of object and heating surface, since the conyection zone moves too.

Furthermore, the device according to the invention can be controlled in large sections of the convection zone. To this end a zone is supplied with the desired energy requirement via temperature and flow profiles that the user can set dependent on the path. The energy requirement is calculated according to the material thickness, the material density or according to the heat capacities of the film to be heated, or empirically. Subsequently the film can be tempered in a targeted manner.

Figure 8:
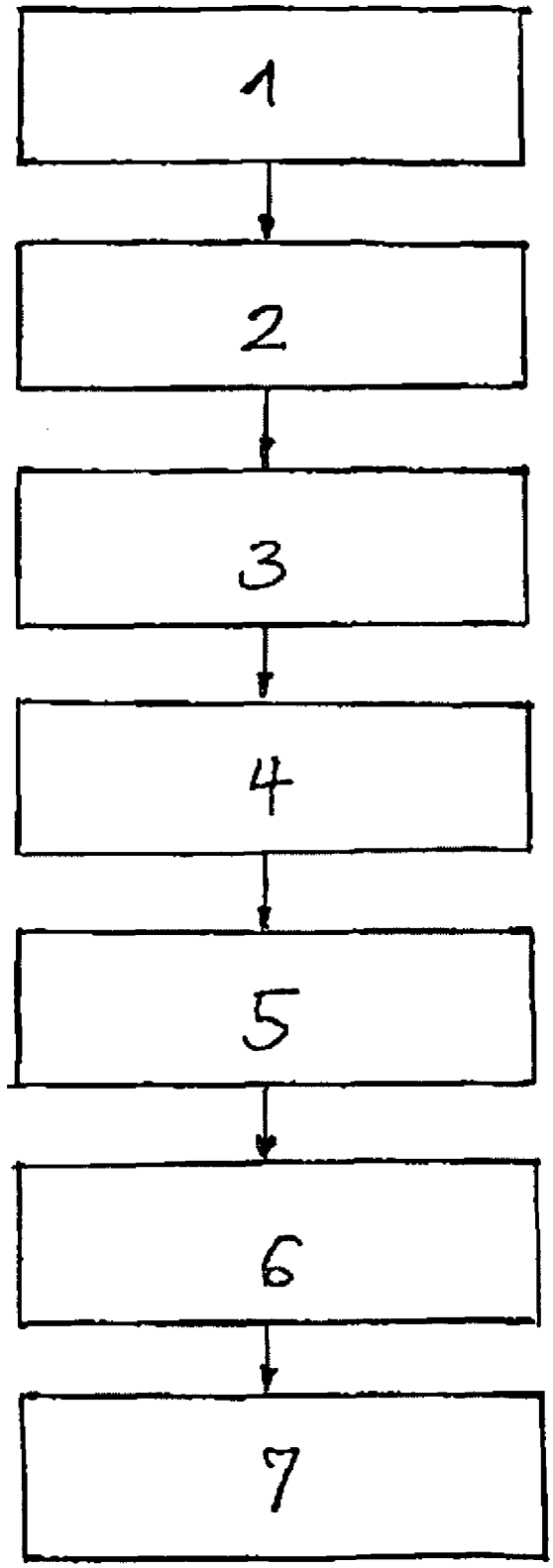

A diagrammatic overview of the process sequence during shrinking is shown by the attached FIG. 8. The meanings are as follows:

1. Wrapping the container with a film
2. Embodying the base area with overlapping film ends
3. Blowing the overlap with hot air guided in reverse flow at 200 to 210°
4. Locally limited dwell period until the film melts, duration 1-2 seconds at flow speeds of 25-35 meters per second
5. Form stabilization of the container through embodiment of a peripheral shall in the base area
6. Complete shrinkage of the film by lateral blowing by means of hot air at increased pressure
7. Blowing with cold air to solidify the film Through the cooling in the last process step, on the one hand the plastic is converted from the plastic range to the elastic range, wherein the maximum stresses in the material rise and it thereby solidifies. On the other hand, the film also shrinks during this cooling, through which the stresses in the film rise and the holding forces stabilizing the container increase. If the environment is too hot, active cooling must be carried out, since the ambient air is not sufficient for solidification.

The invention claimed is:

1. A shrinking process for producing, transportable and printable containers for articles which are taller than they are wide and which include base surfaces and contain heat-sensitive filling substances, comprising:

covering the articles to be packaged with a film such that the film ends overlap in the area of the base surfaces of the articles;

heat sealing by heat transfer or convection overlapping ends in the area of overlap, and then heat shrinking the container in a shrinking oven, the container so produced being stabilized by the shrinking process;

wherein incoming hot air is first locally limited to a base area of the container to form a peripheral shell in an area of the article bottoms, the shape of the container being stabilized thereby, and the container being continuously transported during stabilization, the hot air being directed onto the base area of the container in a bundle of discretely distributed gas jets from a gas circulation system and guided back to the gas circulation system after the locally limited heat transfer with the film, with additional hot gas being directed laterally against the container as it is continuously transported at an increased lateral blow speed in the shrinking oven in order to complete the shrinking process.

2. A shrinking process according claim 1, wherein the film is sealed to form a container base and at the same time is shrunk and a positive formation of the base area of the container is thereby produced.

3. A shrinking process according claim 2, wherein the container is moved on a conveyor device during the sealing operation, wherein the hot air flowing in is suctioned after the heat transfer and is controlled thereby such that the sealing is limited on the area of overlap or a partial area of the base.

4. A shrinking process according claim 1, wherein the container is moved on a conveyor device during the sealing operation, wherein the hot air flowing in is suctioned after the heat transfer and is controlled thereby such that the sealing is limited on the area of overlap or a partial area of the base.

5. A shrinking process according claim 1, wherein local impingement is carried out by activating discretely distributed outflow units and outlet air units that are controlled mechanically, hydraulically or electrically.

6. A shrinking process according claim 5, wherein a vacuum is formed in the outlet air units sufficient to accelerate the hot air out of the outflow units in the area of overlap and to guide it at increased speed over the film ends to be sealed.

7. A shrinking process according claim 5, wherein the control of the inlet air units and outlet air units is carried out by transverse and longitudinal sliders, wherein individual units from the discretely distributed inlet air units and outlet air units are activated according to the local impingement of the film ends in the area of overlap.

* * * * *